US005560133A

United States Patent [19]

Kuebler

[11] Patent Number: 5,560,133

[45] Date of Patent: Oct. 1, 1996

[54] FIREARM GRIP

[76] Inventor: John Kuebler, 720 S. Freeman Rd., Tucson, Ariz. 85748

[21] Appl. No.: 423,737

[22] Filed: Apr. 18, 1995

[51] Int. Cl.[6] ..... F41A 17/00; F41G 11/00

[52] U.S. Cl. ..... 42/69.01; 42/70.01; 42/100

[58] Field of Search ..... 42/69.01, 69.02, 42/69.03, 70.01, 71.01, 71.02, 100

[56] References Cited

U.S. PATENT DOCUMENTS

| | | | |
|---|---|---|---|
| 879,018 | 2/1908 | Stone | 42/70.01 |
| 896,099 | 8/1908 | Gardner | 42/100 |
| 1,475,037 | 11/1923 | Thimgren | 42/69.01 |
| 2,350,833 | 6/1944 | Seitz | 42/69.02 |

*Primary Examiner*—Stephen C. Bentley
*Attorney, Agent, or Firm*—Ogram & Teplitz, P.C.

[57] ABSTRACT

An improved firearm with a grip which positions the index finger to be parallel to the barrel of the firearm. The grip contains a recess or other alignment mechanism along the side of the barrel so that the user is able to position their index finger along the edge of the barrel and parallel to the barrel. This permits the user to obtain a bio-feedback through the index finger as the actual direction where the gun is pointing. Further, in the preferred embodiment, a thumb activated trigger is positioned at the top of the gun so that during firing of the gun, a twisting torque is not exerted on the firearm.

10 Claims, 2 Drawing Sheets

FIREARM GRIP

BACKGROUND OF THE INVENTION

This invention relates generally to firearms and more specifically to the grip used by the user to position and aim the firearm.

Ever since the pistol was first invented in 1540 by Camillo Vettelli in Pistoria, Italy, the challenge to the user has always been to properly aim the weapon so that it hit what was intended. To this end, a large number of sights have been developed to assist the user in the proper alignment of the weapon prior to discharging it. These sights have generally used the approach of providing indexes along the top of the barrel so that the user is able to sight along the barrel to obtain the proper alignment.

One such sight is described in U.S. Pat. No. 4,130,958, entitled "Gun Sight" and issued to Gutridge on Dec. 26, 1978.

One problem with such visual sighting is that often the weapon must be used in dim or dark environments where it is impossible to see the sights so that proper pointing of the weapon is obtained.

Simply "pointing" the weapon at the target is not an acceptable solution as the grip of the weapon is typically at an angle to the barrel. Unless the user has fired an excessive number of rounds through the gun without the use of the sights, the user does not have any "feel" as to where the bullet will impact. Often a bullet shot without the use of sights either harmlessly sails over the top of the target or strikes the earth in front of the target.

An even further problem exists with the actual dynamics created in the firing of the weapon. As the hand squeezes the grip and the trigger is depressed using the index finger, a torque is created in the weapon which tends to rotate the weapon away from the target. This torque is created by mis-alignment of the squeezing index finger outside of the center line of the weapon. There is no known method to correct for this act except for the application of a slow squeeze on the trigger, which is often not possible during the excitement of combat or confrontation.

It is clear from the foregoing that there is a need for an apparatus which permits the gun user to obtain accurate aiming of the weapon without the use of sights.

SUMMARY OF THE INVENTION

The invention is an improved firearm with a grip which positions the index finger to be parallel to the barrel of the firearm. The grip contains a recess (or alignment mechanism), which is adjustable in the preferred embodiment, along the side of the barrel so that the user is able to position their index finger substantially parallel to the barrel.

During use, the paralleling of the barrel by the index finger permits the user to obtain a bio-feedback as to the actual direction where the gun is pointing. In this manner, even in a dim or unlit environment, the user of the gun is able to accurately aim the gun, not through the traditional sights, but through the bio-feedback with their own body.

Further, in the preferred embodiment, a thumb activated trigger is positioned at the top of the gun so that during firing of the gun, a twisting force is not exerted on the firearm.

Whether the embodiment is a rifle, shotgun, handgun, or a grip to be retro-fitted on any of these, the invention creates an embodiment which optimize the use of the firearm by providing for both bio-feedback of the aiming of the weapon as well as enhanced ergo-dynamics involved in the firing of the weapon.

The bio-feedback is obtained by creating, in the grip, a recess is used align and nest the index finger of the user. In the preferred embodiment, two recesses are created, one on each side of the handle so that the grip can be used by either right-handed users or left-handed users.

When the user nests the index finger into the recess, the index finger is positioned to be aligned substantially parallel to the barrel of the gun. The direction felt by the user as to the pointing of the index finger, is identical to the direction of the barrel.

This permits the user to use the weapon, with accuracy, in a dim or unlit environment in which traditional sights cannot be used. The aiming of the weapon becomes a simple task of "pointing" at the target which can be done even with the user's eyes shut.

An enhancement to this invention is the placement of a thumb activated trigger located at the backside of the pistol or weapon and in-line with a center-line of the weapon. Being thumb activated, the depression of the trigger does not have the torque inducing force that a traditional trigger pull creates using the index finger.

A variety of thumb activated triggers are well known to those having ordinary skill in the art including those described by U.S. Pat. No. 4,010,566, entitled "Thumb Trigger and Automatic Safety" issued to Edwards on Mar. 8, 1977; and U.S. Pat. No. 4,070,783, entitled "Thumb Trigger and Automatic Safety" issued to Edwards on Jan. 31, 1978; and U.S. Pat. No. 4,159,670, entitled "Handgun" issued to Turner on Jul. 3, 1979, all of which are incorporated hereinto by reference.

In one embodiment, to prevent unintentional firing of the weapon, a safety mechanism is mounted in the recess in which the index finger is to rest. Only by depressing the safety mechanism with the index finger, or other safety release, will the weapon be dischargeable.

The invention, together with various embodiments thereof will be more fully explained by the accompanying drawings and the following descriptions.

DRAWINGS IN BRIEF

DRAWINGS IN DETAIL

Figure 1:
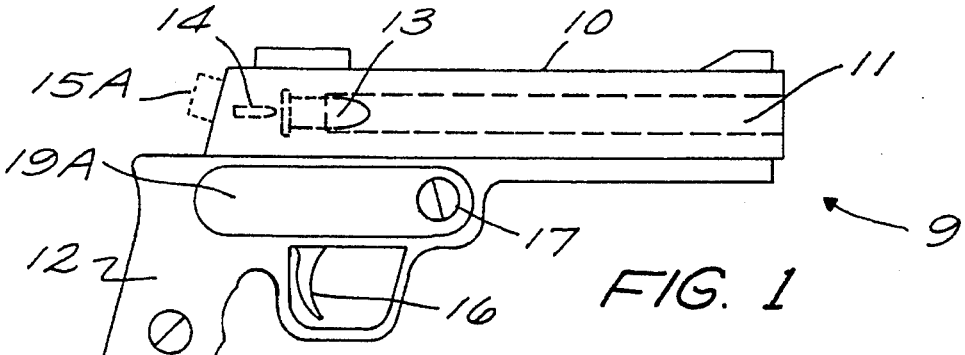
FIG. 1 is a side view of the preferred embodiment of the invention.

FIG. 1 is a side view of the preferred embodiment of the invention.

Pistol 9 has two major components: action mechanism 10 and grip 12.

Action mechanism 10 contains barrel 11 which is used to direct the projectile from bullet 13 once firing pin 14 has impacted and caused the proper explosion. Although this invention discusses the use of explosions caused by gun powder as the force used in creating the ejection of the projectile, the invention is not so limited. Any means for causing the projectile to be ejected are contemplated, including, but not limited to springs, air-pressure, gas release, etc.

Firing pin 14 is activated in this embodiment by depression of trigger 16 which causes through mechanical means not shown, firing pin 14 to impact upon the primer, not shown, of bullet 13. In the preferred embodiment, trigger 15A is also used and is depressed by the user's thumb.

Note, when an automatic pistol is used in this context, trigger 15A must be positioned to permit the slide,action to operate without injuring the user's finger.

Depression using the thumb keeps the force being applied to pistol 9 along a centerline of pistol 9 so that no disturbing torque is applied to the weapon which would twist the pistol off target.

Grip 12 is attached to the pistol 9 and is used to physically manipulate the action mechanism 10. Recess 19A is positioned on grip 12 so that a user's index finger will be substantially parallel to barrel 11. The firing of the firearm is then accomplished by depressing trigger 16 with the center finger or by depressing trigger 15A with the thumb.

Although a recess is described in this embodiment to nest and align the index finger, alternative embodiments utilize raised ribs and bumps to nest and align the index finger to be parallel to the barrel of the weapon.

In the preferred embodiment, as a safety mechanism to prevent the accidental discharge of the weapon, safety sensor 17 is incorporated into grip 12. Safety sensor 17 is used to selectively disengage triggers 15A and 16 from being able to activate firing pin 14. By depressing safety sensor 17, the user is able to fire the weapon; without depressing safety sensor 17, the weapon cannot be discharged.

Other safety features are also contemplated to be used in this context. One such mechanism requires that the grip be depressed for the weapon to be dischargable. Those of ordinary skill in the art readily recognize various other safety mechanisms which can! be utilized in this context.

In this embodiment, grip 12 has seats 18 which accept three of the user's fingers.

Using weapon 9, the user is able to aim and discharge the weapon accurately without having to even actually see the weapon.

Figure 2:
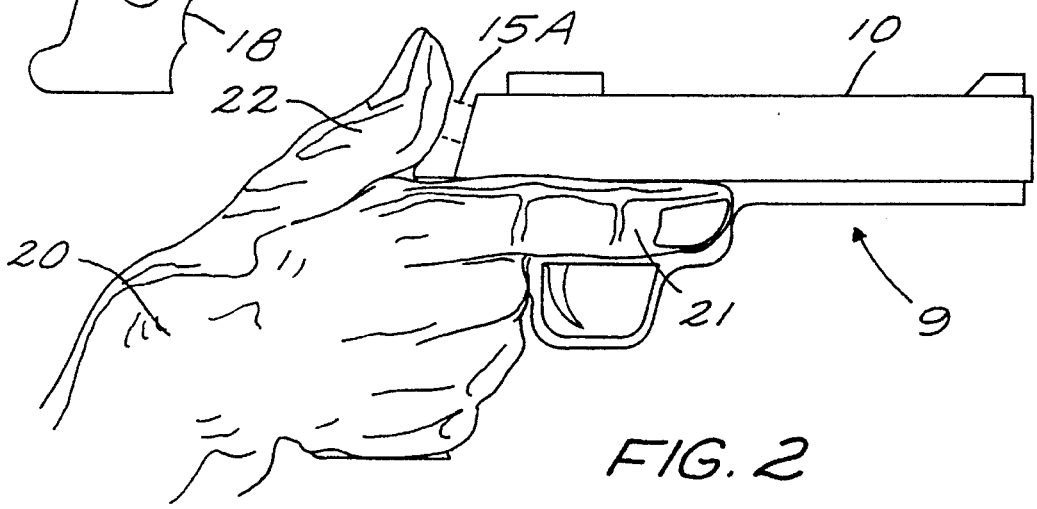
FIG. 2 is a side view of the preferred embodiment illustrating a user's hand positioned on the firearm's grip.

FIG. 2 is a side view of the preferred embodiment illustrating a user's hand positioned on the firearm's grip.

As discussed relative to FIG. 1, user 20 is able to place or nest index finger 21 in the recess (not visible in this view). It is the biofeedback from the pointing of index finger 21 which gives the user the ability to properly point pistol 9.

Once pistol 9 is properly targeted, the user depresses, via his thumb 22, trigger 15A to discharge the weapon. No visual sighting is required.

Figure 3:
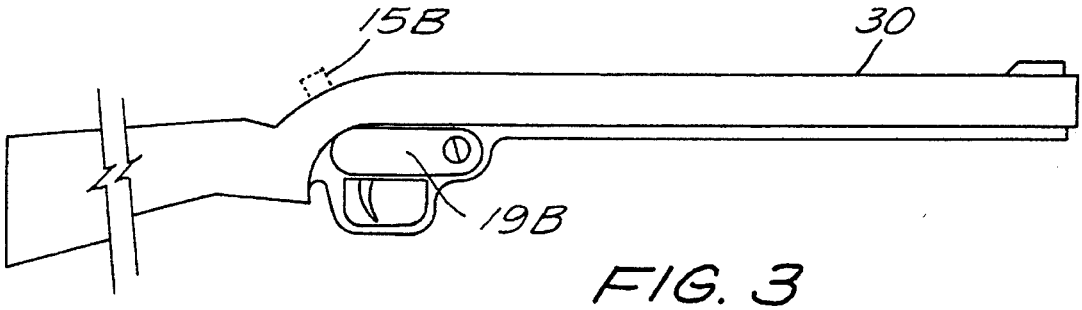
FIG. 3 is an embodiment of the invention as used with rifle or shotgun.

FIG. 3 is an embodiment of the invention as used with firearm 30 which is a rifle, long-gun, or shot-gun.

Firearm 30, as with pistol 9 of FIGS. 1 and 2, is equipped with a grip which aligns the index finger through recess 19B. In the preferred embodiment of firearm 30, a thumb activated trigger 15B is utilized.

Figure 4:
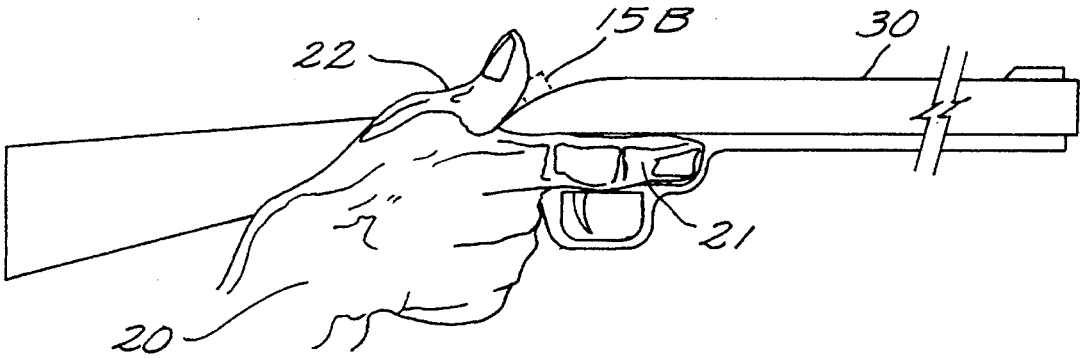
FIG. 4 is a side-view of the embodiment illustrated in FIG. 3 in which the user's hand is properly positioned on the grip.

FIG. 4 is a side-view of the embodiment illustrated in FIG. 3 in which the user's hand 20 is properly positioned on the grip.

As shown, user 20 nests index finger 21 into the recess (now obscured by finger 21) so that the finger and the barrel of rifle 30 are substantially parallel. By depressing trigger 15B with thumb 22 the user is able to fire the weapon.

Figure 5:
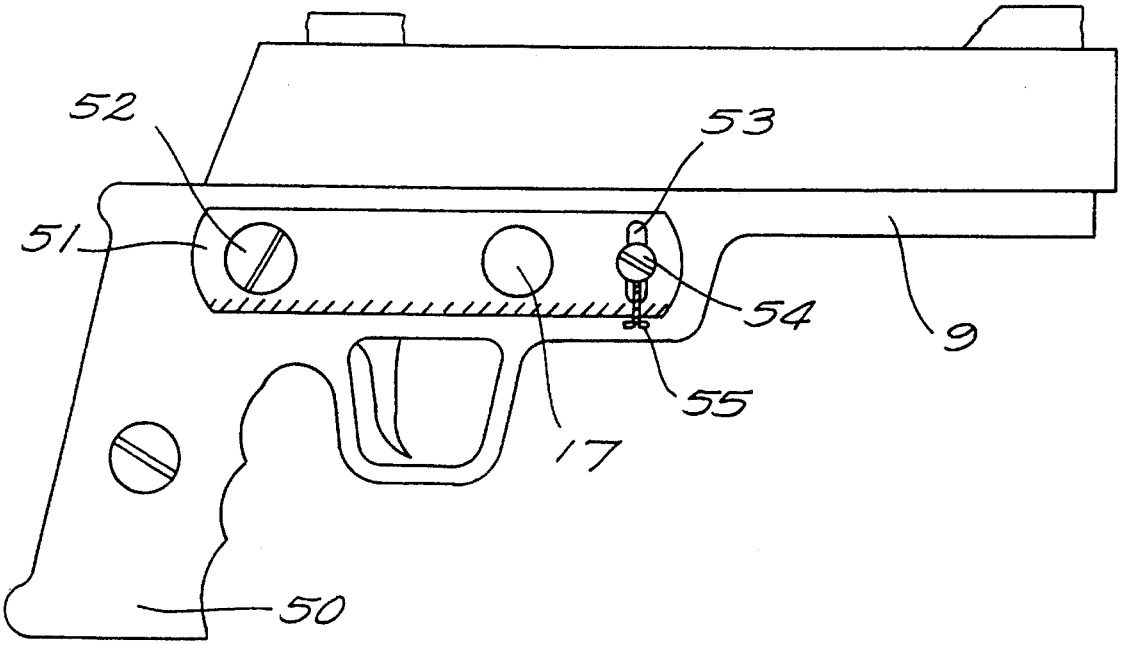
FIG. 5 is an embodiment of the invention which permits adjustment of the recess to correct for the user's individual physical characteristics.

FIG. 5 is an embodiment of the invention which permits adjustment of the recess to correct for the user's individual physical characteristics.

Pistol 9, in this embodiment, retains its traditional grip 50 and shows adjustable recess 51 for alignment of the finger. Adjustable recess 51 is secured to pistol 9 via screws 52 and 54. Screw 54 fits through slot 53.

Adjustable recess 51 is adjusted by way of screw 54 and screw 55. Screw 55 allows adjustment of recess 51.in a vertical plane; screw 54 adjusts recess 51 in a horizontal plane. Screw 54 is further used to attach recess 51 to pistol 9.

This embodiment is particularly useful when there is a need to adjust the recess to fit the physical requirements of the user.

It is clear from the foregoing that the present invention creates a highly improved weapon with the ability to accurately aim the weapon without the use of visual sights.

What is claimed is:

1. A hand-held gun comprising:

a) an action mechanism having, 1) a barrel, 2) a projectile housing positioned at one end of said barrel for housing a projectile to be ejected through said barrel and exiting through an opposing second end thereof, 3) a firing mechanism for initiating ejection of said projectile through said barrel, and, 4) a trigger mechanism being engageable with said firing mechanism and activated by a user for causing said firing mechanism to operate; and, b) a grip attached to said action mechanism for user manipulation of said action mechanism and adapted to held by a single hand, said grip having, 1) a handle portion, 2) a recess portion positioned parallel to said barrel and positioned such that a user's index finger nests in said recess during use, and, 3) sensor means positioned in said recess portion for, A) determining a presence of a user's hand around said grip, and, B) disengaging a connection between said trigger mechanism and said firing mechanism during an absence of a user's hand on said grip.

2. The hand-held gun according to claim 1 wherein said trigger mechanism is activated by a user's thumb.

3. The hand-held gun according to claim 2 wherein said grip includes a second recess positioned parallel to said barrel and wherein said recesses are positioned on opposing sides of said firing mechanism.

4. The hand-held gun according to claim 1 further including means for adjusting an alignment of said recess portion of said grip relative to said barrel.

5. A firearm comprising:

a) a firing mechanism suitable for causing a projectile to be ejected from a barrel therein, said firing mechanism having a trigger mechanism for engaging said firing mechanism; and, b) a grip attached to said firing mechanism for user manipulation of said firing mechanism, said grip having a recess positioned substantially parallel to said barrel and positioned such that a user's index finger nests in said recess during use of said firearm and presses against a sensor therein, said sensor, when engaged, for activating said trigger mechanism.

6. The firearm according to claim 5 wherein said trigger mechanism is activated by a user's thumb.

7. The firearm according to claim 6 wherein said firearm is held by one hand of the user.

8. The firearm according to claim 7 wherein said grip includes a second recess positioned parallel to said barrel and wherein said recesses are positioned on opposing sides of said firing mechanism.

9. A grip for a firearm comprising:

a) a handle portion being structured to be grasped by at least three of a user fingers and held by a single hand to fully support a firearm;

b) an alignment portion positioned such that a user's index finger nested in said alignment portion is substantially parallel to a barrel of a firearm upon which the grip is mounted; and, c) a sensor being deactivated by pressure from the user's index finger, and wherein said sensor is for activation of a safety mechanism in the firearm.

10. The grip according to claim 9 wherein said grip includes a second alignment portion positioned parallel to said barrel and wherein said alignment portions are positioned on opposing sides of said grip.

* * * * *